US006168349B1

(12) United States Patent
Perslow et al.

(10) Patent No.: US 6,168,349 B1
(45) Date of Patent: Jan. 2, 2001

(54) SYSTEM FOR LINING A BANK OF A WATERWAY

(75) Inventors: Johan A. Perslow, Palm Desert; Mark E. Krebs, Huntington Beach, both of CA (US)

(73) Assignee: Pacific Advanced Civil Engineering, Inc., Huntington Beach, CA (US)

( * ) Notice: Under 35 U.S.C. 154(b), the term of this patent shall be extended for 0 days.

(21) Appl. No.: 09/157,476

(22) Filed: Sep. 21, 1998

(51) Int. Cl.[7] ..... E02B 3/12; E02D 5/00

(52) U.S. Cl. ..... 405/16; 405/33; 405/35; 405/272; 405/284

(58) Field of Search ..... 405/15, 16, 30, 405/33, 35, 272, 284

(56) References Cited

U.S. PATENT DOCUMENTS

| | | | | |
|---|---|---|---|---|
| 1,896,989 | * | 2/1933 | Walker | 405/16 |
| 1,990,855 | | 2/1935 | Capps . | |
| 3,412,561 | | 11/1968 | Reid . | |
| 4,278,364 | | 7/1981 | Frehner . | |
| 4,815,897 | | 3/1989 | Risi et al. . | |
| 4,936,713 | | 6/1990 | Miner . | |
| 5,154,542 | * | 10/1992 | Klenert | 405/286 |
| 5,190,403 | | 3/1993 | Atkinson . | |
| 5,399,057 | * | 3/1995 | Cunic | 405/285 |
| 5,509,755 | | 4/1996 | Olsen et al. . | |
| 5,544,973 | | 8/1996 | Frizell et al. . | |
| 5,622,449 | * | 4/1997 | Essay, Jr. | 405/19 |

FOREIGN PATENT DOCUMENTS

| | | |
|---|---|---|
| 761827 | 1/1934 | (FR) . |
| 2335652 | 8/1977 | (FR) . |
| 568622 | 11/1957 | (IT) . |
| 63-176524 | 7/1988 | (JP) . |
| 6-57719 | 3/1994 | (JP) . |

OTHER PUBLICATIONS

Geoweb Cellular Confinement System, Presto Products Company, Geosystems Products, 1996, 8 pages.

* cited by examiner

*Primary Examiner*—Eileen D. Lillis
*Assistant Examiner*—Gary S. Hartmann
(74) *Attorney, Agent, or Firm*—Christie Parker & Hale, LLP

(57) ABSTRACT

A soil cement bank lining system is provided for substantially reducing or eliminating erosion along the banks of a waterway such as a flood conveyance facility. The system includes at least two soil cement linings arranged at spaced apart locations. One or more over-bank grade control structures are interposed between the first and second linings. The respective linings preferably extend parallel to the body of water, with one lining being disposed farther from the body of water and at a higher elevation than the other lining.

23 Claims, 3 Drawing Sheets

SYSTEM FOR LINING A BANK OF A WATERWAY

BACKGROUND OF THE INVENTION

1. Field of the Invention

The present invention relates to systems for lining the banks or shores of a flood conveyance facility, river, or other waterway to control erosion of the banks or shores. More particularly, the invention relates to a multi-level bank lining system that provides significant erosion control, even in extreme weather conditions.

2. Description of the Related Art

The banks of flood conveyance facilities, rivers, and the like (hereinafter "waterways") are dynamic in nature due, among other things, to variations in the water level and flow rate of water through those waterways. High water levels and/or high flow rates can cause significant erosion of the waterways' banks, especially during severe storms, for example during those storms attributed to the El Nino weather phenomenon that intermittently plagues large portions of the United States, and in particular the western states. The erosion of the waterway's banks not only harms ecosystems located in close proximity to the banks, but also damages personal, business, and governmental properties located adjacent to the waterway. Thus, there exists a need to prevent waterway bank erosion, for the above and other reasons.

One method currently practiced is to simply line the banks of the waterway with concrete. Such a method is relatively expensive, and does not permit any vegetation to grow and line the banks. Thus, such a system is not only aesthetically unappealing, it also requires that any vegetation growing along the banks be removed.

Another prior art method is to create what is commonly referred to as a "rip-rap" channel, which essentially consists of a piling of boulders along a waterway's banks. This type of system is also somewhat expensive, in terms of both materials and labor, and does not prevent the bank from deteriorating since the boulders do not provide a water-tight cover over the banks. In addition, because the rip-rap channel covers the bank, native vegetation is not permitted to grow along the bank.

Yet another prior art method is to form a soil cement embankment along the banks of the waterway. Such a method is similar to the concrete embankment described above, in that it covers over the banks and therefore does not permit vegetation to grow along the bank.

Still another prior art method involves the use of spurs, groins, or overbank grade control structures, which are embankments that project into the waterway from its banks, either perpendicular to the bank or at some other angle with respect to the bank. By deflecting the current from the bank and causing sediment deposition behind them, the spurs serve to protect the bank to some extent.

Accordingly, it will be apparent that there continues to be a need for a bank reinforcing system that is only minimally invasive, is relatively inexpensive to implement, and provides significant protection against erosion during both normal conditions and severe weather conditions. The present invention addresses these needs and others.

SUMMARY OF THE INVENTION

Briefly, and in general terms, the present invention is directed to a multi-level system for protecting the banks of a waterway from the erosive forces of the passing water. The system includes at least two soil-cement linings or levels that are positioned at selected, spaced apart locations relative to the waterway. Each lining is at least partially buried into the bank, with the linings cooperating to substantially prevent erosion of the bank, both during normal conditions and extreme weather conditions. At least one over-bank grade control structure is provided and is interposed between the respective linings to provide an added measure of erosion protection along the over-bank area between the respective linings. The multi-level system provides a large, unified mass to substantially prevent erosion in the area between the respective linings.

Thus, in one illustrative embodiment, the present invention is directed to a bank-lining system for reducing erosion along a bank of a waterway, the system comprising: a first lining located at a preselected location with respect to the waterway, the first lining being formed of soil cement; a second lining spaced from the first lining at a preselected location, the second lining being formed of soil cement; and at least one over-bank grade control structure interposed between the first and second linings.

In another embodiment, the present invention is directed to a bank-lining system for lining the banks of a waterway and comprising: a first lining located at a preselected location and extending generally parallel to the waterway, the first lining being formed of soil cement; a second lining spaced a predetermined distance from the first lining and extending generally parallel to the waterway, the second lining being formed of soil cement; and at least one over-bank grade control structure interposed between the first and second linings and extending generally perpendicular to the respective linings.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENTS

Figure 1:
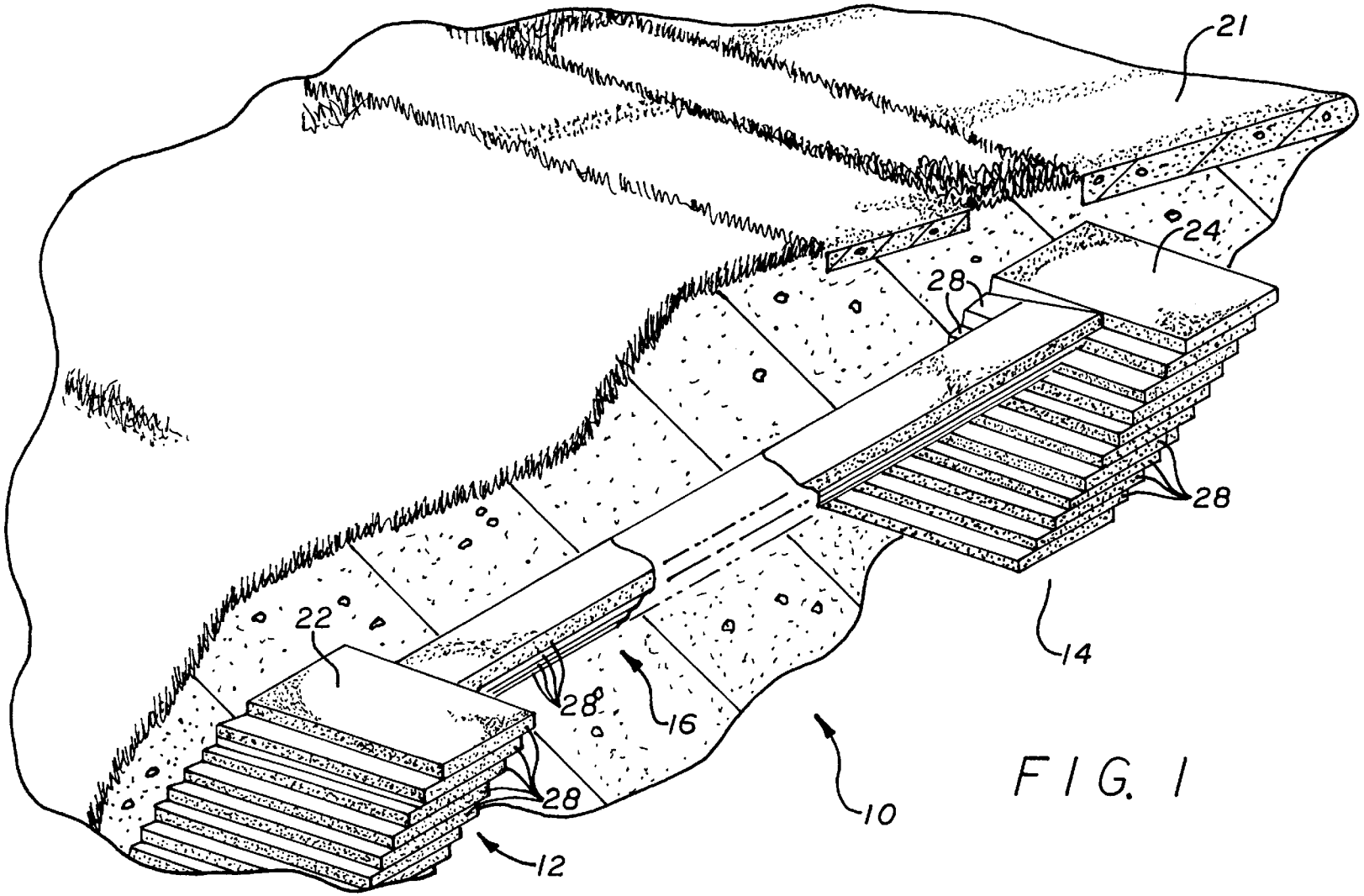
FIG. 1 is a fragmented perspective view of a multi-level soil cement bank lining system depicting one illustrative embodiment of the present invention.
Figure 2:
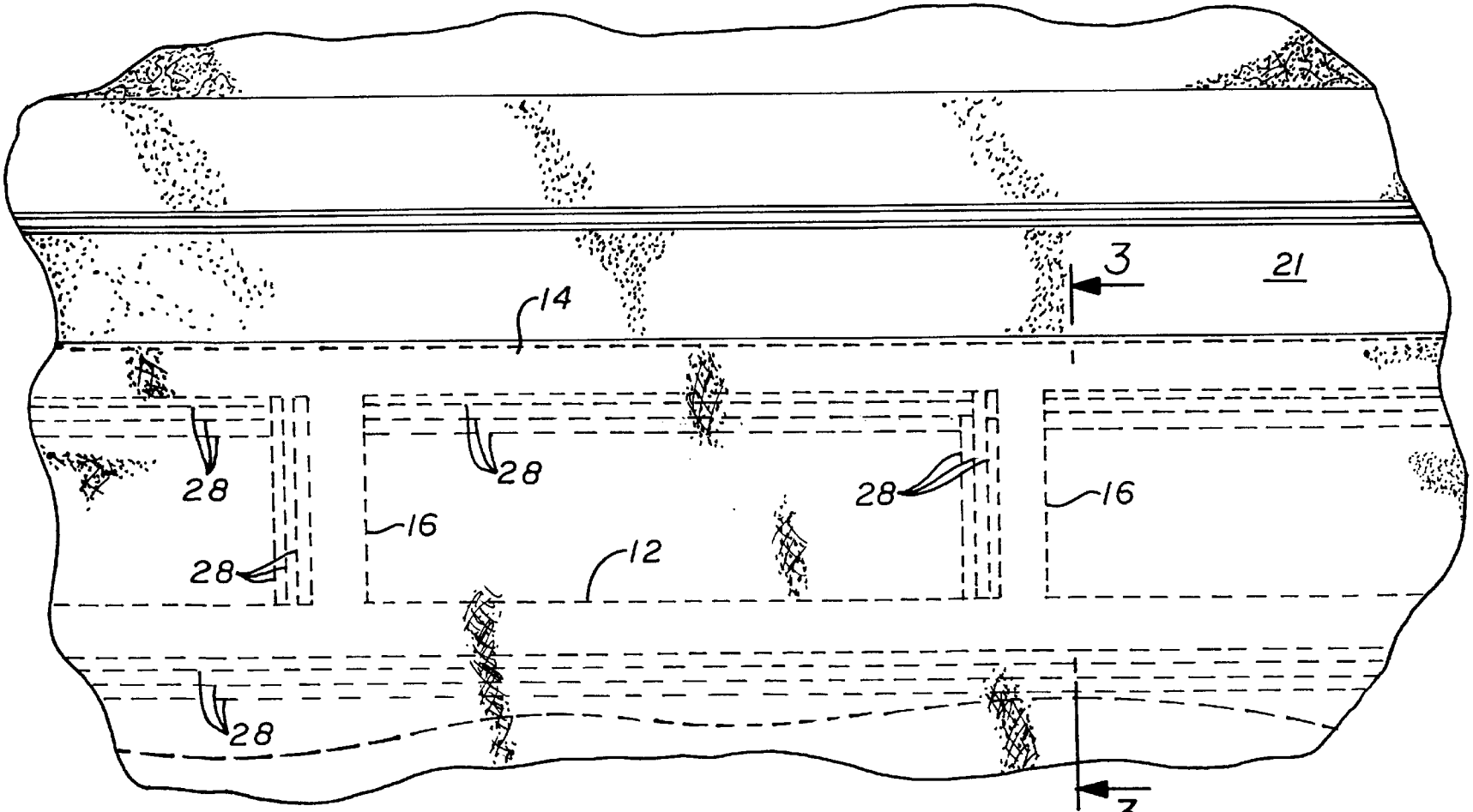
FIG. 2 is a fragmented top plan view of the bank lining system shown in FIG. 1.

In the following detailed description, like reference numerals will be used to refer to like or corresponding elements in the different figures of the drawings. Referring now to FIGS. 1 through 4, there is shown a soil cement bank lining system 10 according to one illustrative embodiment of the present invention. In one illustrative embodiment, the system comprises first and second linings 12 and 14, each of which is formed of soil cement. Interposed between the respective linings are one or more over-bank grade control structures 16. The system is operative to prevent erosion throughout a large area, by including the two spaced apart linings 12 and 14, which cooperate with the earth located between the linings to define a relatively large, unified mass to substantially prevent erosion.

The lower lining 12 is preferably disposed at a location close to the bank of the waterway, while the upper lining 14 is preferably located at a relatively remote location spaced from the lower lining. Therefore, with the lower lining preferably disposed adjacent the waterway, and the upper lining located a significant distance from the lower lining, a buffer area is provided between the two linings. In addition, because the linings are preferably substantially or fully buried beneath the surface of the bank, that buffer area may support existing or new vegetation, which provides an additional means for resisting soil erosion in the event of a flood condition.

The dimensions of the lower and upper linings 12 and 14 is preferably between about six and eight feet wide and between six and twenty feet in height, depending upon the profile. The linings are preferably formed of plural layers or lifts 28 arranged in a stepped configuration (FIG. 1). Thus, in the event a portion of one of the linings becomes exposed, the stepped configuration allows easy pedestrian access to and from the channel bed, which is extremely beneficial in the event of an emergency condition, for example during extreme flooding. Preferably, the linings are formed of layers having approximately a 12" tread and 12" riser configuration. Thus, the steps have a 1:1 rise-to-run ratio, each each layer is approximately eight feet wide and one foot tall. The linings preferably slope downwardly and toward the waterway (FIG. 3).

As described above, the upper and lower linings 12 and 14 are preferably about six to eight feet wide, whereas a conventional reinforced concrete lining is on the order of only eight to twelve inches wide, as a wider concrete lining would be cost-prohibitive. Thus, the present invention provides numerous advantages over those conventional concrete linings, including acting as a gravity retaining wall, offering significantly more resistance to hydraulic pressures and dynamic hydraulic loads, as well as offering increased flexibility over the conventional concrete linings. Soil cement is also resistant to surface erosion. These advantages make the multi-level system 10 a very stable embankment lining system.

By providing at least two linings 12 and 14, each embankment can be made more shallow than a conventional single-level embankment lining system. This reduces the amount of vegetation and soil removal required during installation, such that the installation is only minimally invasive as compared with conventional single-level systems. Moreover, as described above, the long-term effect of the system 10 on the surrounding ecological community is virtually non-existent, as the linings are substantially, if not completely, buried.

Figure 3:
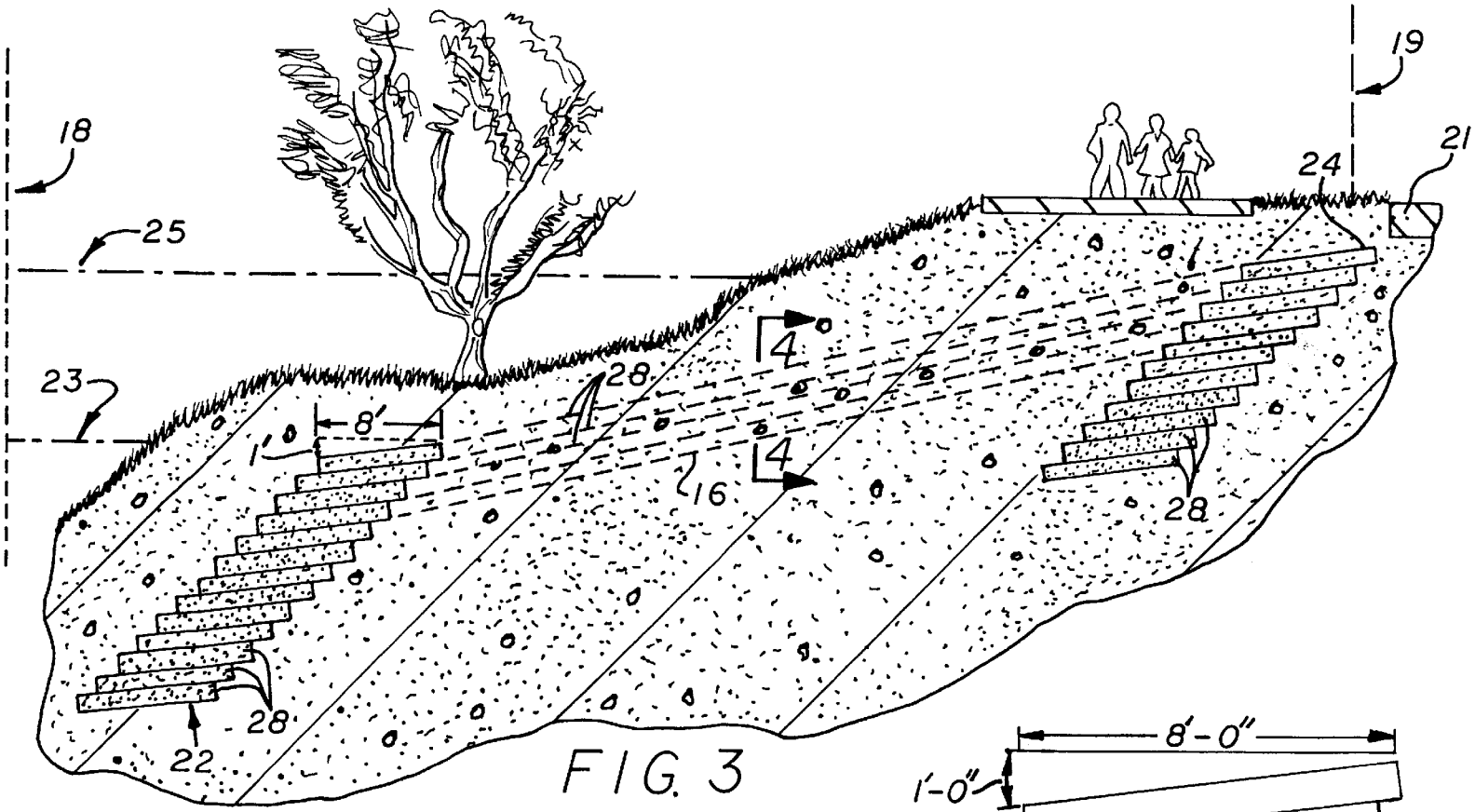
FIG. 3 is a fragmented cross-sectional view taken along the line 3—3 of FIG. 2.
Figure 4:
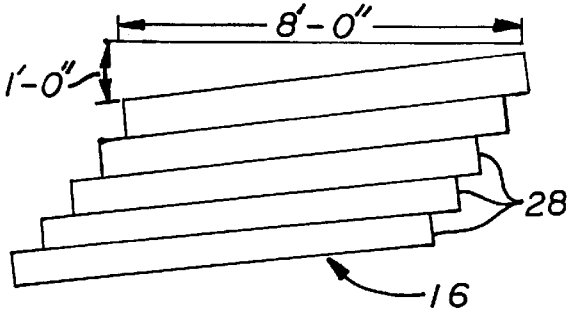
FIG. 4 is a cross-sectional view taken along the line 4—4 of FIG. 3.

The linings 12 and 14 are preferably sloped at an angle of between about 8°–10° with respect to the horizontal (i.e., the layers 28 have about a 5 ½ to 8:1 slope and angle downwardly and toward the waterway) (FIG. 3).

In the preferred embodiment, the upper end 22 of the lower lining 12 is preferably located at a height above a known flood line 23 for frequent rainfall events of the particular waterway (FIG. 3), while the upper end 24 of the upper lining 14 is preferably located at a height above a 100-year flood line 25 for the particular waterway. Therefore, the multi-level system offers protection against water surface levels due to frequent rainfall events as well as the less-frequent one hundred year floods, without requiring a relatively deep excavation.

The upper and lower linings 12 and 14 are spaced apart a distance determined in part by the contour of the bank for the particular waterway. Typically, the linings are spaced between 20 and 200 feet apart, usually between 30 and 80 feet apart, and optimally about 60 feet apart. In this manner, the lower lining will be disposed at a first elevation to resist erosion during frequently-occuring flood conditions, while the upper lining is disposed at a relatively higher elevation to resist erosion during more severe flood conditions.

The overall heights of the lower and upper linings 12 and 14 varies depending upon the flood levels for the waterway and other factors. Typically, the height of the lower lining 12 ranges between about 10 and 25 feet, and the height of the upper lining 14 ranges between about 10 and 20 feet.

The "toe-down" of the lower lining 12 (the depth of the lining below the channel invert of the waterway) is preferably made sufficiently deep to account for dynamic changes in waterway elevations, especially during storms and extreme weather conditions. The toe-down must take into account long-term degradation (i.e., a reduction in channel sediment transport capacity), local scour (scour at bridge abutments, piers, and the like), bedform or antidune height, bend scour (due to transverse or secondary currents from changes in current flow direction at waterway bends), and low flow incisement (incised channels created during periods of low flow rates).

While the bank lining system 10 is shown as including a single lower lining 12 and a single upper lining 14, it will be apparent to those skilled in the art that the system 10 may include more than two linings, with each adjacent pair having one or more over-bank grade control structures 16 interposed between the adjacent linings.

The over-bank grade control structures 16 are also formed of plural layers or lifts 28 arranged in a stepped configuration. The over-bank grade control structures serve to provide additional stabilization of the overbank area in addition to tying the upper and lower linings 12 and 14 together, thereby creating a unified mass defined by the linings and the soil interposed between the linings. This significant, unified mass serves to resist erosion, even in the case of a major flood event. The unified bank lining is a massive, interlocked structure which is relatively immune to disturbance by even the most catastrophic flood. The over-bank grade control structures are preferably sloped at an angle of between about 8°–10° with respect to the horizontal (i.e., the layers 28 have about a 5 ½ to 8:1 slope and angle downwardly in a direction parallel to the waterway) (FIG. 3).

In one illustrative embodiment, the over-bank grade control structures 16 are approximately sixty feet long and span from the upper lining to the lower lining in a direction generally perpendicular to the respective linings. The over-bank grade control structures are also preferably formed of soil cement, and preferably have a width of about eight feet. The over-bank grade control structures are preferably spaced apart between about 200 and about 400 feet along the bank.

The linings 12 and 14 and over-bank grade control structures 16 are preferably formed of soil cement. Soil cement, as is well known in the art, comprises a mixture of soil and measured amounts of a cement, for example Portland cement, and water, all of which is compacted to a high density. Alternatively, soil cement can be formed by blending, compacting, and curing a mixture of soil/aggregate, Portland cement, and water to form a hardened material. The soil/aggregate particles are bonded by the cement paste but are not completely coated with the paste as in a concrete mixture. Various different soils can be used to make effective soil cement. Preferably, sand or silty sand with a high dry unit weight is used.

From the foregoing, it will be apparent that the multi-level bank lining system of the present invention protects the banks of a waterway from the erosive forces of the passing water. The multi-level design provides a large, unified mass to substantially prevent erosion, even during major floods.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A bank-lining system for reducing erosion along a bank of a waterway, the system comprising:

a first lining located at a preselected location with respect to the waterway, the first lining being formed of soil cement;

a second lining spaced from the first lining at a preselected location, wherein the second lining is disposed further from the waterway than the first lining, the second lining being formed of soil cement; and at least one over-bank grade control structure interposed between the first and second linings.

2. The system of claim 1, wherein the first lining is at least partially buried.

3. The system of claim 1, wherein the second lining is at least partially buried.

4. The system of claim 1, wherein the first and second linings comprise plural lifts formed of soil cement and arranged in a stepped configuration.

5. The system of claim 1 further including plural over-bank grade control structures at respective spaced apart locations, each over-bank grade control structure being interposed between the first and second linings.

6. The system of claim 5, wherein the over-bank grade control structure is generally perpendicular to the linings, and wherein the linings extend generally parallel to the waterway.

7. The system of claim 5, wherein the over-bank grade control structures are spaced between 200 and 400 feet apart.

8. The system of claim 1, wherein the first and second linings angle downwardly and toward the waterway.

9. The system of claim 1, wherein the over-bank grade control structure angles downwardly in a direction generally parallel to the waterway.

10. The system of claim 1 further including at least one additional lining spaced from the first and second linings, and at least one additional over-bank grade control structure interposed between the additional lining and one of the first and second linings.

11. The system of claim 1, wherein the first and second linings are spaced between 20 and 200 feet apart.

12. The system of claim 1, wherein the first and second linings are spaced between 30 and 80 feet apart.

13. The system of claim 1, wherein the first and second linings are disposed at different elevations.

14. A bank-lining system for reducing erosion along a bank of a waterway, the system comprising:

a first lining located at a preselected location and defining a longitudinal axis extending generally parallel to the bank of the waterway, the first lining being formed of soil cement;

a second lining spaced a predetermined distance from the first lining and defining a longitudinal axis extending generally parallel to the bank of the waterway, the second lining being formed of soil cement; and at least one over-bank grade control structure interposed between the first and second linings and extending generally perpendicular to the respective linings.

15. The system of claim 14, wherein the first lining is at least partially buried.

16. The system of claim 14, wherein the second lining is at least partially buried.

17. The system of claim 14, wherein the first and second linings comprise plural lifts formed of soil cement and arranged in a stepped configuration.

18. The system of claim 14 further including plural over-bank grade control structures at respective spaced apart locations, each over-bank grade control structure being interposed between the first and second linings.

19. The system of claim 18 wherein the over-bank grade control structures are spaced between 200 and 400 feet apart.

20. The system of claim 14 further including at least one additional lining spaced from the first and second linings, and at least one additional over-bank grade control structure interposed between the additional lining and one of the first and second linings.

21. The system of claim 14, wherein the first and second linings are spaced between 20 and 200 feet apart.

22. The system of claim 14, wherein the first and second linings are spaced between 30 and 80 feet apart.

23. The system of claim 14, wherein the first and second linings are disposed at different elevations.

* * * * *